US006669291B1

(12) United States Patent
Hsiao

(10) Patent No.: US 6,669,291 B1
(45) Date of Patent: Dec. 30, 2003

(54) MASSAGING DEVICE FOR A CHAIR WITH RESILIENT STRAPS

(76) Inventor: Yun-Chien Hsiao, No. 276, Sec. 2, Hai-Tien Rd., Tainan (TW)

( * ) Notice: Subject to any disclaimer, the term of this patent is extended or adjusted under 35 U.S.C. 154(b) by 0 days.

(21) Appl. No.: 10/350,074

(22) Filed: Jan. 24, 2003

(51) Int. Cl.[7] ..... A47C 7/62; A61H 1/00

(52) U.S. Cl. ..... 297/284.3; 297/217.3; 601/57; 601/70

(58) Field of Search ..... 297/284.3, 284.5, 297/217.3, 15; 601/56, 57, 70, 136

(56) References Cited

U.S. PATENT DOCUMENTS 5,305,738 A * 4/1994 Shimizu ..... 601/75
5,374,238 A * 12/1994 Xiao ..... 601/57
5,462,515 A * 10/1995 Tseng ..... 601/57
6,007,501 A * 12/1999 Cabados et al. ..... 601/15
6,123,389 A * 9/2000 O'Connor et al. ..... 297/397
6,431,646 B1 * 8/2002 Longoria ..... 297/217.3
6,511,446 B1 * 1/2003 Wu ..... 601/15

* cited by examiner

*Primary Examiner*—Anthony D. Barfield
(74) *Attorney, Agent, or Firm*—Rabin & Berdo, P.C.

(57) ABSTRACT

A massaging device for a chair having multiple resilient straps has a massaging housing, a vibration device and a massaging face. The massaging housing has a front case and a rear case, and multiple connecting fins are formed inside the massaging housing. The vibration device is securely mounted between the connecting fins in the massaging housing. The vibration device has a motor with a protruding motor shaft and an offset flywheel securely attached to the protruding shaft. The massaging face has an outer surface with at least one massaging bulb and an inner surface. At least one strap groove with two ribs is formed on the inner surface of the massaging face, and at least one strap is securely mounted in the at least one strap groove. The massaging face securely connects to the outer surface of the front case of the massaging housing.

3 Claims, 6 Drawing Sheets

MASSAGING DEVICE FOR A CHAIR WITH RESILIENT STRAPS

BACKGROUND OF THE INVENTION

1. Field of the Invention

The present invention relates to a massaging device for a chair with multiple resilient straps, and the massaging device is detachably mounted on the chair in any desired position. Multiple massaging devices are mounted on the resilient straps of the chair to enlarge the massaging area.

2. Description of Related Art

With reference to FIGS. 4 to 6, a conventional massaging device (2) for a chair comprises a gearbox (46), a guide sprocket (not shown), a track (42) and a vibration device (62). The track (42) comprises a groove (422), a top (not numbered), a bottom (not numbered) and a back (not numbered). The gearbox (46) is securely mounted on the top of the track (42), and the guide sprocket is securely mounted at the bottom of the track (42) in a guide sprocket housing (48). The back of the track (42) is securely mounted on a back panel (not numbered), and the back panel is securely mounted inside a chair back (not numbered). The gearbox (46) comprises a gear assembly (not numbered) and a chain (41). The chain (41) is driven by the gear assembly between the gear box (46) and the guide sprocket.

A vibrator housing (60) comprises a vibration device (62), and multiple massaging wheels (66). The massaging wheels (66) are rotatably mounted on the vibrator housing (60). The vibrator housing (60) is moveably mounted in the groove (422) and is driven along the groove (422) of the track (42) by the chain (41). The vibration device (62) mounted in the vibrator house (60) comprises a motor (not shown), a protruding motor shaft (not shown) with an offset flywheel (not shown) mounted on the protruding motor shaft.

When power is supplied to the massaging device (2) inside the chair back and the vibration device (60) is activated, the offset flywheel on the protruding motor shaft rotates and vibrates the massaging wheels (66). The gear assembly drives the chain (41) and the attached massaging wheels (66) back and forth between the gear box (40) and the guide sprocket housing (48). Therefore, the massaging wheels (66) vibrate and move between the gear box (46) and guide sprocket housing (48).

One of the disadvantages of the conventional massaging device is that the massaging device is difficult and expensive to repair when the massaging device is mounted in a chair back. Moreover, the heat generated by the massaging device builds up in the chair back within a short period of time after the massaging device is activated. Sitting in the chair with a conventional massaging device becomes uncomfortable due to the build up of heat in the chair back especially during the summer. Third, the massaging wheels (66) move along the groove (422) in the track (42), which cover a limited small portion of chair back area. In short, the conventional message device for a chair has several disadvantages including the chair warming up quickly and the massaging area being small.

To overcome the shortcomings, the present invention provides an improved massaging device for a chair with resilient straps to mitigate the aforementioned problems.

SUMMARY OF THE INVENTION

The primary objective of the present invention is to provide a massaging device that can be mounted and operated on a chair without building up heat in the chair.

Another objective of the present invention is to provide massaging devices that can be selectively mounted on a chair with resilient straps to adjust the massaging area to a desired shape, size or position.

To accomplish the foregoing objectives, the present invention comprises a massaging housing, a vibration device and a massaging face. The vibration device is securely mounted in the massaging housing, and resilient straps of the chair are securely clamped between the massaging face and the massaging housing. Multiple massaging devices are used to enlarge massaging area.

Other objectives, advantages and novel features of the invention will become more apparent from the following detailed description when taken in conjunction with the accompanying drawings.

DETAILED DESCRIPTION OF THE PREFERRED EMBODIMENT

Figure 1:
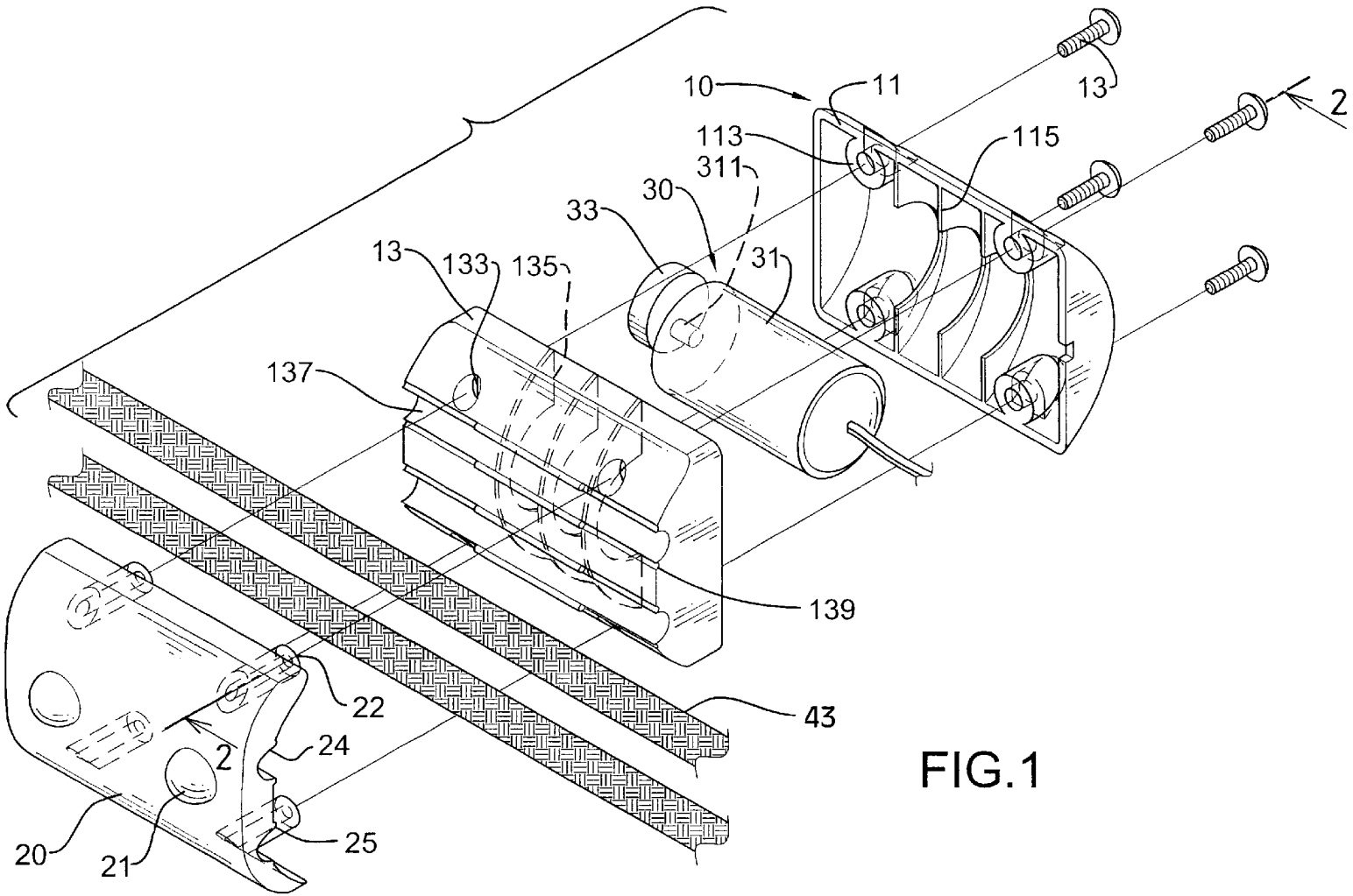
FIG. 1 is an exploded perspective view of a massaging device for a chair with resilient straps.

With reference to FIG. 1, a massaging device for a chair with resilient straps (43) comprises a massaging housing (10), a vibration device (30) and a massaging face (20). The vibration device (30) comprises a motor (31) with a protruding motor shaft (311) and an offset flywheel (33). The offset flywheel (33) is securely mounted on the protruding motor shaft (311).

Figure 2:
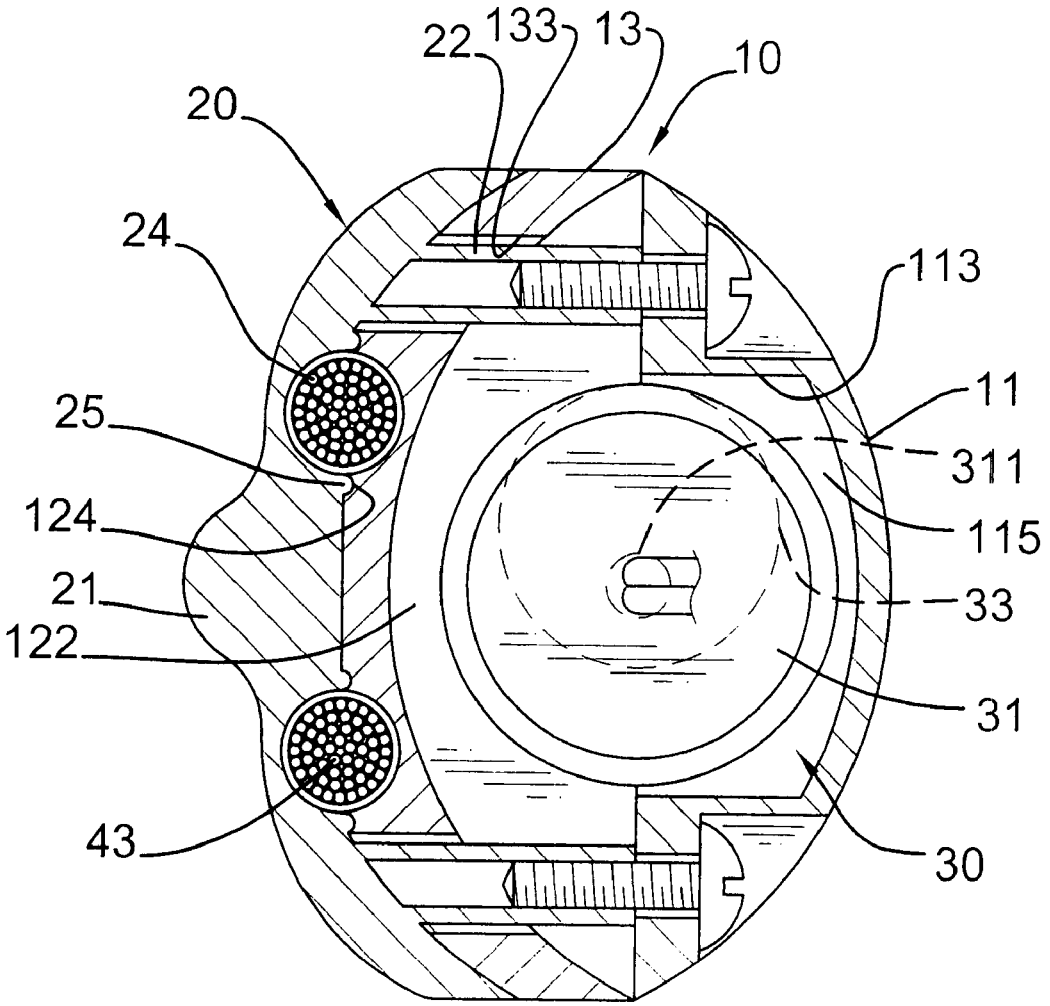
FIG. 2 is a side plan view of the massaging device in partial section along line 2—2 in Fig. 1.

With reference to FIG. 1 and 2, the massaging housing (10) comprises a rear case (11) and a front case (13). The rear case (11) comprises an inner surface (not numbered) and an outer surface (not numbered). Multiple hollow stubs (113) are formed on the inner surface of the rear case (11). The front case (13) comprises an inner surface (not numbered) and an outer surface (not numbered). Multiple through holes (133) extend through the front case (13). The massaging housing (10) provides means to securely mount the motor (31) of the vibration device (30) inside the massaging housing (10), and the means comprises multiple fins (115, 135) formed on the inner surface of the front and rear cases (13, 11).

At least one strap groove (137) is formed on the outer surface of the front case (13). Two connecting grooves (139) are formed on the outer surface of the front case (13) and respectively at two sides of each at least one strap groove (137).

The massaging face (20) comprises an outer surface (not numbered) and an inner surface (not numbered). At least one massaging bulb (21) is formed on the outer surface of the massaging face (20). The inner surface of the massaging face (20) comprises means to attach the massaging face (20) to the outer surface of the front case (13). The means comprises multiple hollow stubs (22) formed on the inner surface of the massaging face (20). At least one strap groove (24) and two ribs (25) are formed on the inner surface of the massaging face (20), and the ribs (25) abutted with the connecting grooves (139) to engage with the corresponding connecting grooves (139). Multiple screws (not numbered) extend respectively through the hollow stubs (113) in the rear case (11), the through holes (133) in the front case (13) and screw into the hollow stubs (23) on the massaging face (20). Therefore, the means of attaching the inner surface of the massaging face (20) to the outer surface of the front case (13) is to attach the massaging face (20) to the outer surface of the front case (13) with screws screwed into studs on the massaging face (20).

Figure 3:
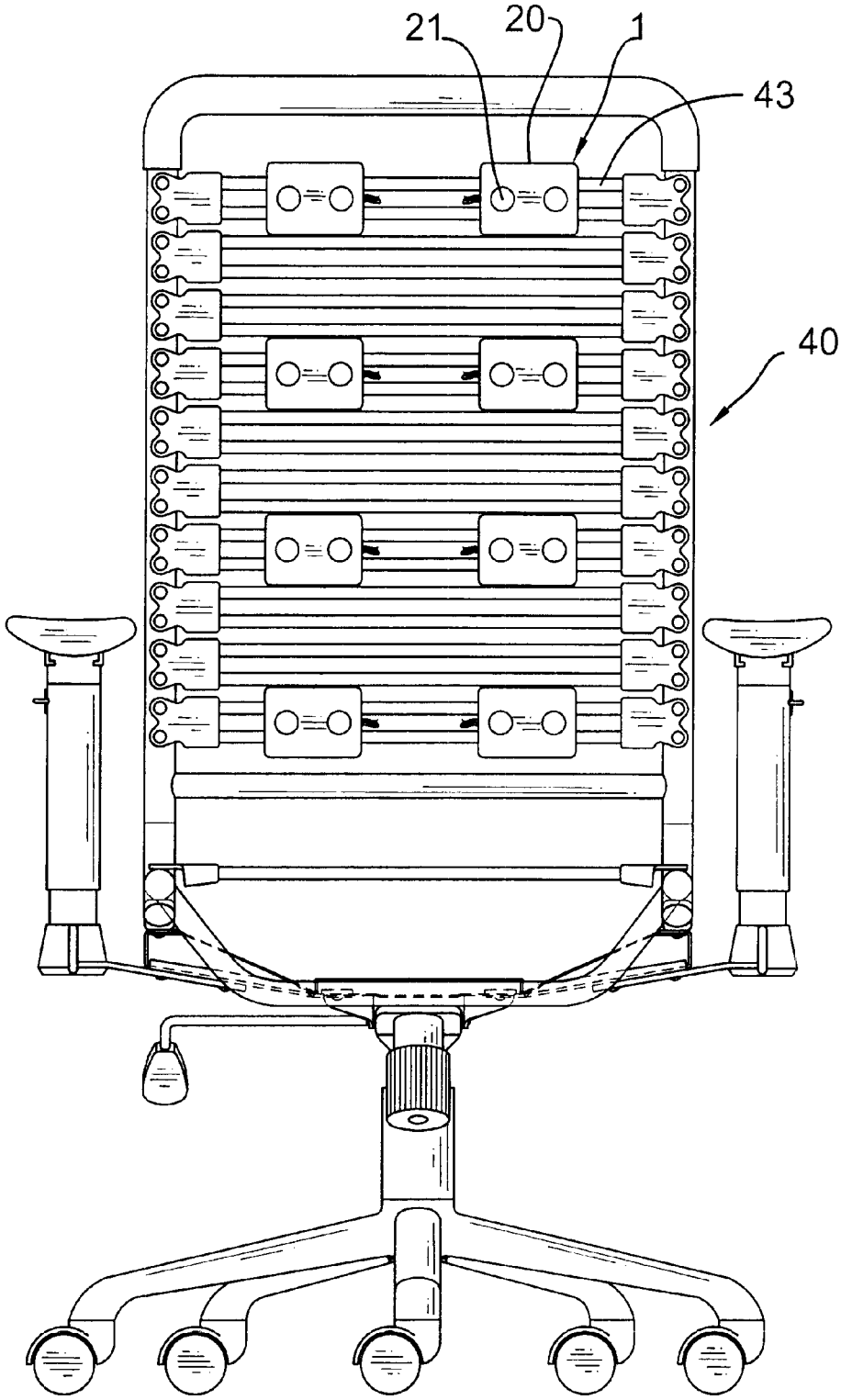
FIG. 3 is an operational front plan view of massaging devices in FIG. 1 mounted on a chair.
Figure 4:
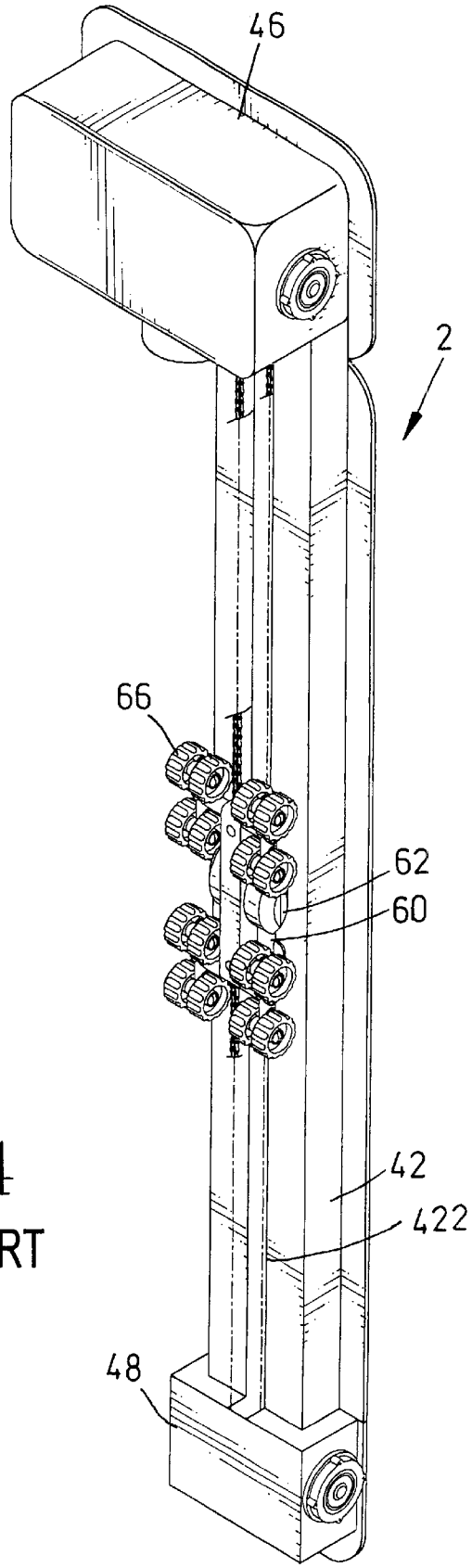
FIG.4 PRIOR ART
FIG. 4 perspective view of a conventional massaging device in accordance with the prior art.
Figure 5:
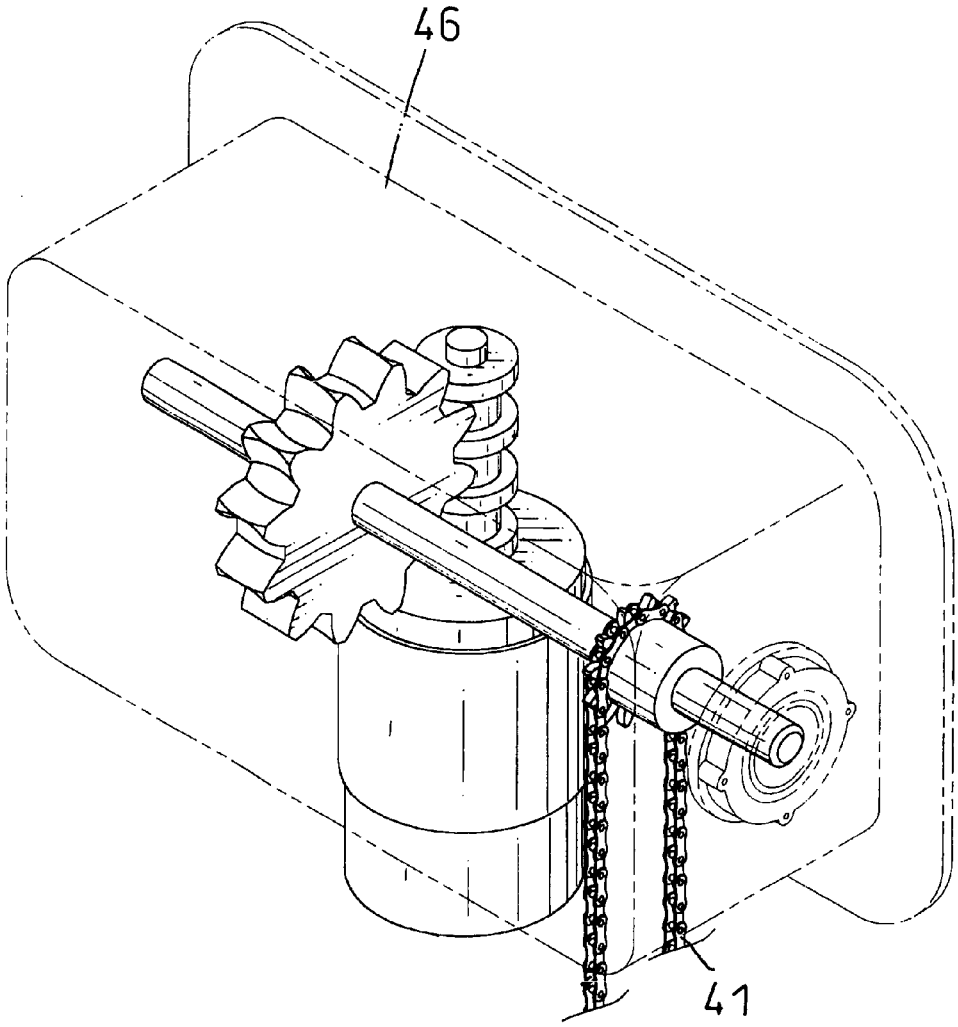
FIG.5 PRIOR ART
FIG. 5 is a perspective interior view of a gearbox for the conventional massaging device in FIG. 4.
Figure 6:
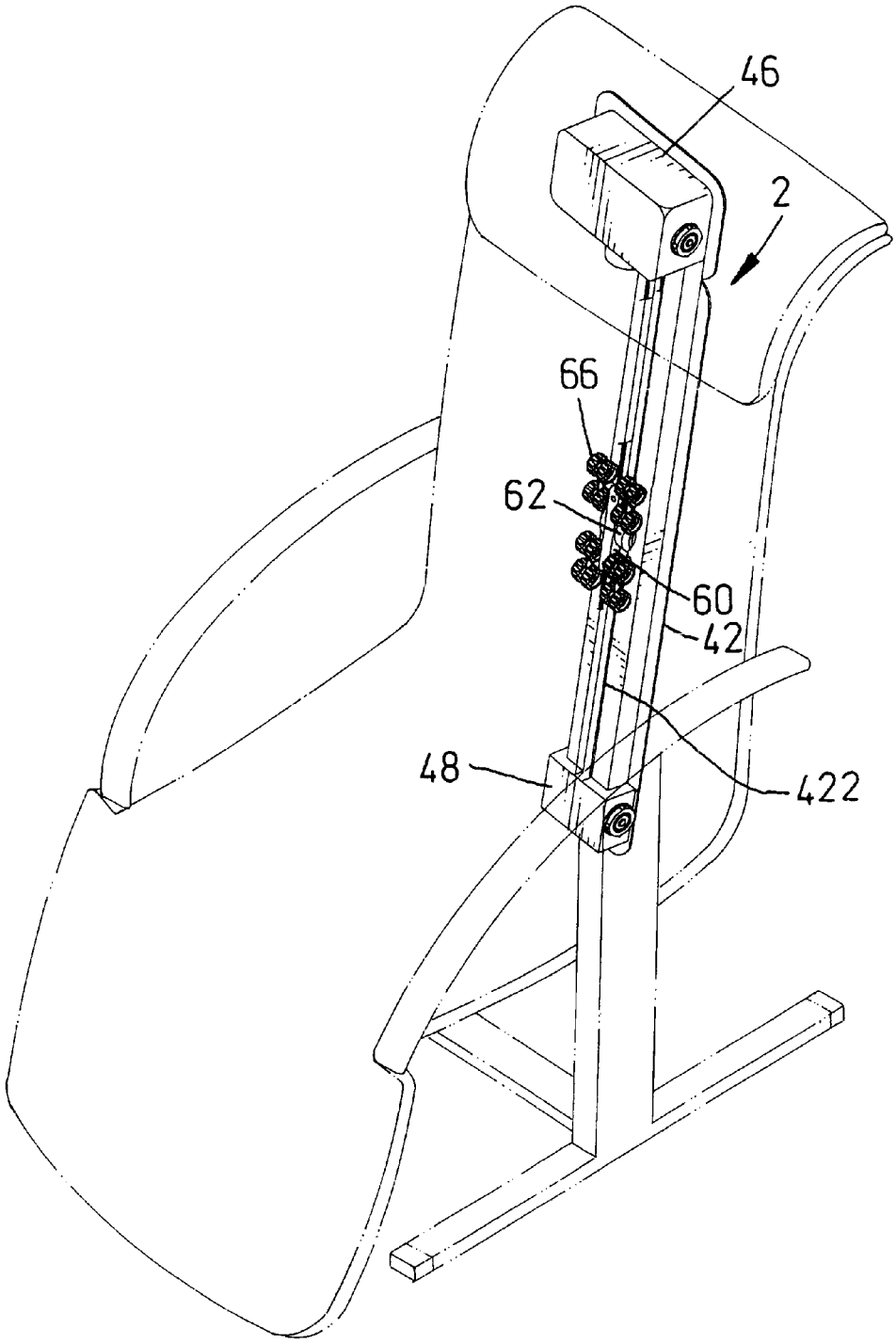
FIG.6 PRIOR ART
FIG. 6 is a perspective view of the conventional massaging device in FIG. 5 mounted in a chair.

With reference to FIG. 3, a chair comprises a chair back and multiple resilient straps (43), and each of the resilient straps (43) has two ends (not numbered). The chair back comprises a frame (not numbered) with two sides (not numbered), multiple fasteners (not numbered) and multiple strap connectors (not numbered). The strap connectors are respectively attached to two sides of the frame and each corresponds to one of the others, and two resilient straps (43) are attached between each pair of corresponding strap connectors on two sides of the frame. At least one massaging device is attached to the straps (43) between the corresponding strap connector.

With reference to FIGS. 1 to 3, the resilient straps (43) securely mounted on the frame of the chair back are detachably mounted in the strap grooves (137, 24) between the outer surface of the front case (13) and the inner surface of the massaging face (20). The ribs (25) on massaging face (20) mate with the corresponding connecting grooves (139) on the front case (13). When the massaging face (20) is detached from the outer surface of the front case (13), the resilient straps (43) will automatically leave a position where the straps (43) are clamped between inner surface of the massaging face (20) and the outer surface of the front case (13). Therefore, the massaging device will taken away from the resilient straps (43) of the chair back. The massaging device can be attached to another position on the chair back by means of clamping the massaging device to another different resilient straps (43).

With reference to FIG. 3, the offset flywheel (33) on the protruding motor shaft (311) rotates and creates vibration movement for the massaging device (1) when power is supplied to the motor (31) of the vibration device (30) and the massaging device (1) is turned on. The vibration movement causes the massaging bulb (21) on the massaging face (20) to vibrate and to massage a desired area on a human body.

The advantages of this invention are that the massaging devices can be attached to any desired position on the chair (40) and are exposed to ambient air so heat does not build up around them. The massaging devices are attached or detached from the chair by simply removing the massaging face (20) from the front case (13) and the resilient straps (43) from the strap grooves (137, 24). The massaging area can be enlarged by adding additional massaging devices to the chair. When one of the massaging devices (1) needs to be repaired, the broken massaging device can be removed from the chair (40) and repaired. A great deal of money can be saved by being able to repair individual massaging devices rather than an entire apparatus. Furthermore, the remaining massaging devices can be used while one is being repaired.

It is to be understood that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A massaging device for a chair having at least one resilient strap on the chair back, and the massaging device comprising:

a massaging housing comprising:

a front case having an inner surface and an outer surface, and the outer surface comprising;

at least one strap groove formed on the outer surface and adapted to be connect to the at least one resilient strap of the chair; and two connecting grooves formed on the outer surface and respectively at two sides of each at least one strap groove on the outer surface of the front case adapted to securely hold the resilient strap in position; and a rear case attached to the front case and having an inner surface and a connecting device to connect the rear case to the inner surface of the front case;

a vibration device received in the massaging housing and comprising;

a motor with a protruding motor shaft, and the motor securely mounted in the massaging housing with means for holding the motor in the massaging housing;

an offset flywheel attached to the protruding motor shaft;

a massaging face attached to the front case and comprising:

two opposite surfaces, where one surface is an inner surface and the other surface is an outer surface;

the outer surface of the massaging face adapted to contact a human body, and the outer surface comprising:

at least one massaging bulb formed on the outer surface; and the inner surface having an attaching device to attach the massaging face to the outer surface of the front case, and the inner surface comprising;

at least one strap grooves formed on the inner surface and adapted to receive the at least one resilient strap of the chair in cooperation with the at least one strap groove in the front case; and two ribs formed on the inner surface, and engaging with the two connecting grooves on two sides of each at least one strap groove in the front case.

2. The massaging device as claimed in claim 1, wherein the means of attaching the inner surface of the massaging face to the outer surface of the front case comprises hollow stubs formed on the inner surface of the messaging face and screws screwed into studs on the messaging face.

3. The massaging device as claimed in claim 1, wherein the connecting device to mount the motor in the massaging housing comprises multiple connecting fins respectively formed on the inner surfaces of the front and rear cases of the massaging housing.

* * * * *